US006259203B1

(12) United States Patent
Kawamura et al.

(10) Patent No.: US 6,259,203 B1
(45) Date of Patent: Jul. 10, 2001

(54) ORGANIC ELECTROLUMINESCENT DEVICE

(75) Inventors: Hisayuki Kawamura; Chishio Hosokawa, both of Sodegaura (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 0 days.

(21) Appl. No.: 09/121,831

(22) Filed: Jul. 24, 1998

(30) Foreign Application Priority Data

Jul. 31, 1997 (JP) ..... 9-205579

(51) Int. Cl.[7] ..... H05B 33/26

(52) U.S. Cl. ..... 313/506; 428/690; 428/917; 313/504

(58) Field of Search ..... 313/506, 502, 313/501, 503, 504; 428/690, 917

(56) References Cited

U.S. PATENT DOCUMENTS 3,932,291 1/1976 Donohue .
5,336,546 8/1994 Hironaka et al. .
5,420,288 5/1995 Ohta et al. .
5,484,922 1/1996 Moore et al. .

FOREIGN PATENT DOCUMENTS 0 610 514 8/1994 (EP) .
0 700 917 3/1996 (EP) .

OTHER PUBLICATIONS

H. Usui, et al., Thin Solid Films, vol. 288, No. 1, pp. 229–234, "Ionization–Assisted Deposition of $Alq_3$ Films", Nov. 15, 1996.

*Primary Examiner*—Ashok Patel
(74) *Attorney, Agent, or Firm*—Oblon, Spivak, McClelland, Maier & Neustadt, P.C.

(57) ABSTRACT

Provided is a practical organic electroluminescent (EL) device, of which the luminance is not attenuated in long-term driving. The device has good luminous efficiency and durability. At least one organic compound to be used for forming the organic compound layer of the device has an electron spin number of not more than $10^{13}$ per mg of the compound.

10 Claims, 1 Drawing Sheet

ORGANIC ELECTROLUMINESCENT DEVICE

FIELD OF THE INVENTION

The present invention relates to an organic electroluminescent (EL) device.

More precisely, it relates to an organic EL device of which the luminance is not attenuated in long-term driving and which has good durability.

BACKGROUND OF THE INVENTION

As being self-emission, EL devices have high self- distinguishability. In addition, they have high impact resistance as being completely solid devices. Therefore, the use of EL devices in various displays as light source is being widely noticed.

EL devices are grouped into inorganic EL devices in which are used inorganic compounds as light-emitting materials, and organic EL devices in which are used light-emitting organic compounds. Of those, organic EL devices have been being much studied and expected as practical light emitters in the coming generations, since they require a greatly reduced driving-voltage and they can be easily small-sized.

In the circumstances, the most important theme in practical studies of organic EL devices is to establish the technique of preventing the attenuation of the luminance of the devices in long-term driving and to provide practicable organic EL devices.

In this respect, it is known that the purity of organic compounds to be used for producing organic EL devices has a great influence on the attenuation of the luminous efficiency and the luminance of the devices produced, for example, as in "Monthly DISPLAY, September, p. 15, 1995", and "OYOBUTURI, Vol. 66, No. 2, pp. 114–115, 1997". However, the influences of the structures and the properties of organic compounds to be used for producing organic EL devices on the properties of the devices produced are not as yet clarified, and no method is known capable of quantitatively determine the influences in question.

Therefore, the details of the reasons why long-term use of organic EL devices brings about the attenuation of the luminance of the devices are not as yet known at present.

SUMMARY OF THE INVENTION

Given that situation, the object of the invention is to solve the problems in the prior art noted above, and to provide a practical organic EL device of which the luminance is not attenuated in long-term driving and which has good durability.

We, the present inventors have assiduously studied in order to attain the object.

Through our studies, we measured the number of electron spins existing in each organic compound to be used for forming the organic compound layers of organic EL devices, and have found that a good correlation was obtained between the number of electron spins and the properties of organic EL devices. Specifically, of many organic EL devices we produced, those which comprised organic compounds having a large number of electron spins existing therein were impracticable for long-term driving, as their luminance greatly attenuated in practical use.

The reason is because a large number of electron spins existing in organic compound layers of organic EL devices will trap the holes and electrons as injected into the layers to thereby probably increase the driving voltage for the devices and quench the excited state of the light-emitting compounds of the devices.

On the basis of this knowledge, we have found that, in order to prevent the attenuation of the luminance of organic EL devices being driven for a long period of time, at least one of organic compounds to be used for forming the organic compound layers of each organic EL device must be such that the number of electron spins existing therein is not more than $10^{13}$ per mg of the compound.

Based on this finding, we have completed the present invention.

Specifically, the invention provides the following:

(1) An organic EL device comprising one or more organic compound layers that include at least one organic light-emitting layer and are sandwiched between a pair of electrodes of anode and cathode, wherein at least one of organic compounds used for forming the organic compound layers is such that the number of electron spins existing therein is not more than $10^{13}$ per mg of the compound.

(2) The organic EL device of (1), wherein the organic compound layers are formed through vapor deposition.

(3) The organic EL device of (1) or (2), wherein the number of electron spins existing in the organic compound used for forming the organic light-emitting layer is not more than $10^{13}$ per mg of the compound.

(4) The organic EL device of (1) or (2), wherein the number of electron spins existing in the organic compound used for forming the organic compound layer for hole injection or transportation is not more than $10^{13}$ per mg of the compound.

(5) The organic EL device of (1) or (2), wherein the number of electron spins existing in the organic compound used for forming the organic compound layer for electron injection or transportation is not more than $10^{13}$ per mg of the compound.

BRIEF DESCRIPTION OF THE DRAWING

The FIGURE of the Drawings is a simplified depiction of an organic luminescent device wherein:

1 is an anode;

2 is a cathode; and

Figure 1:
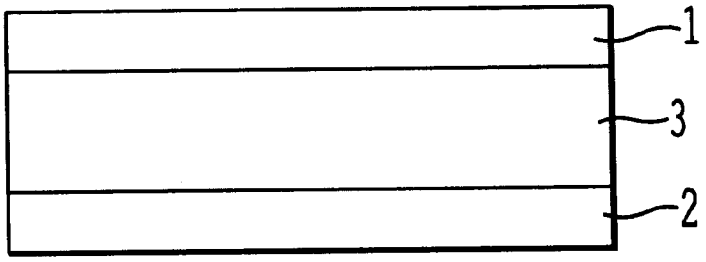

3 is at least one organic light emitting layer, including hole injection and transportation layer(s).

DETAILED DESCRIPTION OF PREFERRED EMBODIMENTS CF THE INVENTION

Now, the invention is described in detail hereinunder.

The organic EL device of the invention is characterized in that the number of electron spins existing in at least one of organic compounds used for forming the organic compound layers of the device is not more than $10^{13}$ per mg of the compound.

In the organic EL device of the invention, the organic compound layer to be between the anode and the cathode includes at least one light-emitting layer. The organic compound layer may be composed of light-emitting layer(s) only, or may have a multi-layered laminate structure composed of light-emitting layer(s), hole injection and transportation layer(s), and others.

In the organic EL device, the light-emitting layer has (1) a function to inject holes thereinto from the anode or the hole transportation layer and to inject electrons thereinto from the electron injection layer, while it is in an electric field, (2) a transportation function to move the thus-injected charges (electrons and holes) by the force of the electric field, and (3) a light-emitting function to provide the site for recombination of those electrons and holes inside the layer so as to emit light. The electron injection layer for (1) has a specific function to well inject electrons from the cathode into the organic compound layer.

The type of the light-emitting material for the light-emitting layer is not specifically defined, and any and every light-emitting material known in the field of organic EL devices is usable for the layer.

The hole injection and transportation layer comprises a hole-transmitting compound, and has a function to transmit the holes having been injected thereinto from the anode, to the light-emitting layer. The hole injection and transportation layer is put between the anode and the light-emitting layer so that many holes are injected into the light-emitting layer in a lower electric field. In this structure, an electron barrier is formed in the interface between the light-emitting layer and the hole injection and transportation layer, and it assists the electrons having been injected from the electron injection layer into the light-emitting layer to accumulate inside the light-emitting layer around the interface, to thereby improve the luminous efficiency of the EL device. Accordingly, the EL device having this structure shall have excellent light-emitting capabilities. The hole transmitting compound to be used for forming the hole injection and transportation layer is not specifically defined, and any and every hole-transmitting compound known in the field of organic EL devices is usable for the layer. The hole injection and transportation layer is not limited to a single-layered one but may be a multi-layered one. Apart from those noted above, minor additives of organic compounds may be added to any of these layers.

The minor additives are of so-called dopants, which are to improve the charge injectability into the layers constituting organic EL devices or are light-emitting species by themselves to improve the properties of organic EL devices.

At least one of organic compounds to be used for forming the organic compound layers of the organic EL device of the invention shall be such that the number of electron spins existing therein is not more than $10^{13}$ per mg of the compound, which generally means that the organic compound to form at least one organic compound layer of the device or the dopant to be added to the organic light-emitting layer (s) and others of the device is such that the number of electron spins existing therein is not more than $10^{13}$ per mg of the compound or the dopant.

To measure the number of electron spins existing in the organic compound that is to form the organic compound layer of the device, employed is an electron spin resonance (ESR) measurement.

This method is described below.

First, the weight of an empty sample tube made of quartz is weighed. Next, a suitable amount of an organic compound to be used for forming the organic compound layer of the device is put into the tube, which is then weighed. By subtracting the former from the latter, obtained is the weight of the organic compound for forming the organic compound layer. This is referred to as $\chi$ mg.

Using a commercially-available ESR measurement apparatus, the compound in the sample tube is subjected to ESR measurement to obtain its ESR signal pattern, from which is obtained the area of ESR. This is designated by E.

Next, a standard sample of which the electron spin number is known (for example, 1,1-diphenyl-2-picrylhydrazyl, DPPH) is measured in the same manner as previously, and the area of ESR is obtained from its ESR signal pattern. The electron spin number and the ESR area of the standard sample are designated by ns and Es, respectively.

The electron spin number, n, of the organic compound is obtained according to the following equations:

$$n:E=n_s:E_s \quad (1)$$

$$n=E/E_s\times n_s \quad (2)$$

Accordingly, the electron spin number, $\alpha$, per mg of the organic compound is represented by the following equation:

$$\alpha=\frac{n}{\chi} \quad (3)$$

The details of the origin of the electron spins as to from what substances the electron spins are derived to be in organic compounds are not clear at present, but it is believed that the electron spins will be derived from the radical of the organic compound itself or from the ion species or radical species of solvents and impurities that may contaminate the organic compound.

Such ion species or radical species, if any, in the organic compound layers of organic EL devices will be the factors to cause charge trapping in the layers or inactivation of the excited layers, resulting in that the driving voltage for the devices is increased and the light-emitting capability of the devices is canceled.

In general, it is well known that purification by sublimation is one effective method for purifying the materials for organic EL devices. In this connection, we have found that the purification by sublimation is especially effective for decreasing the number of electron spins in those materials.

Accordingly, it is expected that the number of electron spins to be in organic EL devices that comprise organic compound layers as formed through vapor deposition of organic compounds under reduced pressure will be somewhat lower than that of electron spins to be in the organic compounds that are in vaporization boats.

On that presumption, if organic compounds to be vaporized for forming the organic compound layers of organic EL devices contain a large number of electron spins, some of such many electron spins will still remain in the devices produced, thereby to worsen the capabilities of the devices.

Accordingly, in producing organic EL devices, it is extremely effective to reduce the number of electron spins to be in the organic compounds of the vaporization source through purification by sublimation and to use the thus-purified organic compounds for forming the organic compound layers of the devices through vapor deposition, thereby to prevent the deterioration of the capabilities of the devices produced.

In order to prevent the attenuation of the luminance of organic EL devices according to this extremely effective method, it is important to use at least one organic compound of which the value a noted above is not more than $10^{13}$. In particular, it is important that the value $\alpha$ of the organic compounds to be used for forming the light-emitting layers of the devices is not more than $10^{13}$.

Apart from the sublimation method noted above, other various methods are known for purifying organic compounds to be used for producing organic EL devices. For example, known are methods of recrystallization, reprecipitation, zone melting, column purification, adsorption, etc.

However, in any of those conventional purification methods, the purification limit is at most such that the electron spin number per mg of the purified organic compound, $\alpha$, falls between $10^{13}$ and $10^{15}$. The degree of purification on such a level could not satisfactorily attain the object of the invention.

Therefore, in order to maintaain the condition of $\alpha \leqq 10^{13}$/mg, which is required by the invention, by reducing the number of electron spins to be in organic compounds that are used for vaporization sources, it is necessary to combine some of the conventional purification methods for purifying the organic compounds.

One preferred embodiment of the combination of the conventional purification methods comprises the following [1], [2] and [3], by which the number of electron spins to be in organic compounds of vaporization sources may be more effectively reduced.

[1] The compound is sublimed at a temperature lower by at least 30° C. than its pyrolyzing point.

[2] The initial sublimate is cut off at a temperature falling a temperature range lower by 20 to 50° C. than the sublimation point of the compound.

[3] The vacuum degree for the sublimation falls between $10^{-8}$ and $10^{-2}$ Torr, but preferably between $10^{-8}$ and $10^{-5}$ Torr.

In actual purification, suitable methods are selected depending on the properties of the organic compounds to be purified, but are not specifically defined so far as they maintain the condition of $\alpha \leqq 10^{13}$/mg.

Now, the invention is described in more detail with reference to the following Examples, which, however, are not intended to restrict the scope of the invention.

PRODUCTION EXAMPLE 1

Production of Luminous Material:

This is to demonstrate the production of a luminous material, 4,4"-bis(2,2-diphenylvinyl-1-yl)-p-tert-phenylene (DPVTP).

The compound has a structure of the following chemical formula:

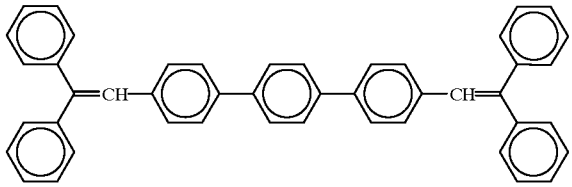

In a 100-ml three-neck flask charged with argon, 1.0 g of benzophenone and 1.2 g of a phosphate, of which the structure is shown below, were suspended in 30 ml of dimethylsulfoxide that had been dried through a molecular sieve.

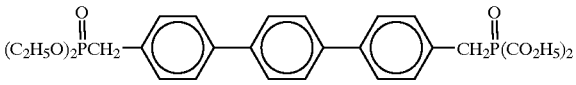

The resulting suspension was reacted with 0.5 g of potassium t-butoxide added thereto, at room temperature, whereupon the reaction product formed immediately colored in reddish brown in the suspension. Next, this was stirred for about 1 hour at 27° C., and the reaction product then colored in yellow therein. This was further stirred for 2 hours, to which was added 40 ml of methanol, and the yellow precipitate was taken out through filtration.

Next, the yellow precipitate was suspended in 100 ml of toluene, and subjected to hot extraction. Toluene was evaporated from the resulting extract to obtain a white powder. This was purified by sublimation at a boat temperature of 320° C. in a vacuum of $10^{-2}$ Torr to obtain 0.45 g of a pure powder. This is referred to as DPVTP-1.

This was again purified by sublimation at a boat temperature of 320° C. in a vacuum of $10^{-5}$ Torr to obtain 0.38 g of a further purified powder. This is referred to as DPVTP-2.

PRODUCTION EXAMPLE 2

Production of Hole-Injecting Material:

This is to demonstrate the production of a hole-injecting material, 4,4',4"-tris-[N-(m-tolyl)-N-phenylamino] triphenylamine (MTDATA).

The compound has a structure of the following chemical formula:

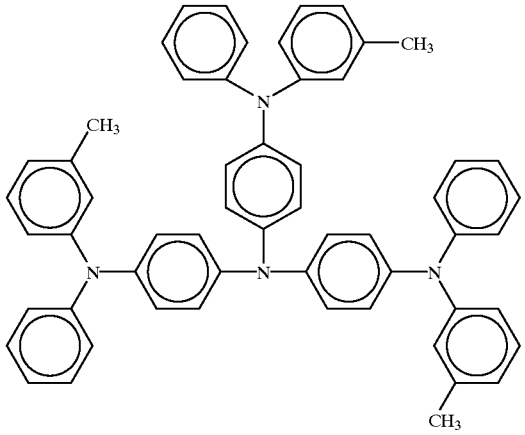

1.0 g of 4,4',4"-triiodo-triphenylamine, 1.0 g of N-(3-tolyl)-N-phenylamine (by Aldrich), 3 g of potassium carbonate anhydride, and 1.0 g of copper powder were put into a 300-ml three-neck flask, dissolved in 200 ml of dimethylsulfoxide, and reacted by stirring them at 20° C. for 8 hours.

After the reaction, the reaction mixture was filtered, and the mother filtrate was extracted with methylene chloride. The solvent was evaporated in a rotary evaporator, and the residue was purified through a chromatography column charged with silica gel (by Hiroshima Wako Pure Chemicals), for which toluene was used as the developer, to obtain 0.3 g of a pale yellow powder. This is referred to as MTDATA-1.

This was purified by subliming it three times at a boat temperature of 390° C. and in a vacuum of $10^{-5}$ Torr, to obtain 0.24 g of a pale yellow powder. This is referred to as MTDATA-2.

PRODUCTION EXAMPLE 3

Production of Hole-Transporting Material:

This is to demonstrate the production of a hole-transporting material, N,N'-di-(naphthyl-1-yl)-N,N'-diphenyl-4,4"-benzidine (NPD).

The compound has a structure of the following chemical formula:

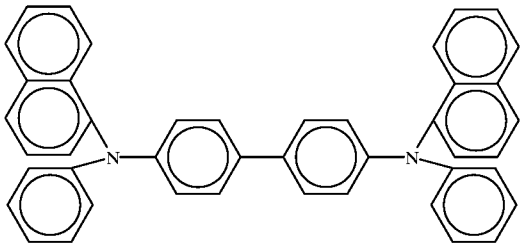

In the same manner of reaction and purification as in Production Example 2, except that 2.0 g of 1-iodonaphthalene (by Tokyo Chemical) was used in place of 4,4',4"-triiodo-triphenylamine and that 1.0 g of N,N'-diphenylbenzidine (by Hiroshima Wako Pure Chemicals) was used in place of N-(3-tolyl)-N-phenylamine (by Aldrich), 0.37 g of a pale yellow powder was obtained. This is referred to as NPD-1.

This was purified by subliming it two times at a boat temperature of 320° C. and in a vacuum of $10^{-5}$ Torr to obtain 0.31 g of a pale yellow powder. This is referred to as NPD-2.

PRODUCTION EXAMPLE 4

Production of Dopant:

This is to demonstrate the production of a dopant, 4,4'-bis-[2-[4-(N,N-diphenylamino)phenyl-1-yl]-vinyl-1-yl]-1,1'-biphenyl (DPAVBi).

The compound has a structure of the following chemical formula:

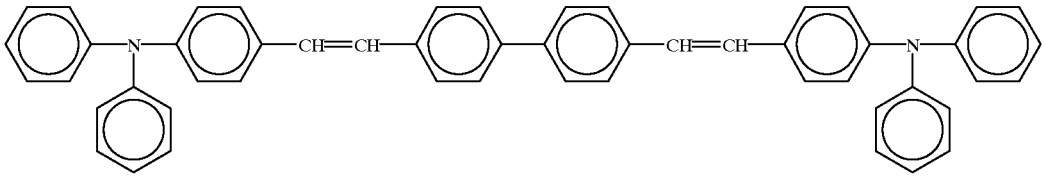

1.9 g of the same sulfonate as that used in Production Example 1, and 3.0 g of N,N-diphenyl-4-aminobenzaldehyde were put into a 200-ml three-neck flask, and dissolved in 50 ml of dimethylsulfoxide that had been dried through a molecular sieve. While this was stirred with a magnetic stirrer at room temperature in an argon gas atmosphere, 1.0 g of powdery potassium t-butoxide (by Kanto Chemical) was added thereto little by little. The reaction mixture immediately became reddish black, and then faded for a while to be greenish yellow. Finally, it gave an ocher precipitate.

After the reaction, the reaction mixture was stirred for further 3 hours still at room temperature. Next, this was allowed to stand at room temperature overnight, then 50 ml of aqueous 80 wt. % methanol was added thereto, and the yellow precipitate thus formed was taken out through filtration. This was washed two times with 50 ml of aqueous 80 wt. % methanol, and then two times with 50 ml of methanol. This was dried in vacuum at 50° C. for 3 hours to obtain 2.8 g of an yellow powder.

Next, the thus-obtained yellow powder was developed through a column of chromatography as charged with 140 g of silica gel (BW-820MH, trade name of Fuji DavisonChemical) along with toluene, using toluene as the developer, from which was collected the first developed fraction. In this thin-layer chromatography (developer of toluene/n-hexane=2/1, V/V, thin layer of silica gel), the rate of flow, Rf was 0.8.

Next, the fractions containing the intended product were collected, and the solvent was evaporated with an evaporator to give a dry solid powder. The thus-obtained yellow powder was dissolved in 60 ml of hot toluene, and the insoluble was removed by filtration through a membrane filter (by Advantec, 1 $\mu$m, 25 $\mu$mm).

This toluene solution was allowed to stand at room temperature, and the precipitate formed was taken out through filtration, and dried at 50° C. for 2 hours to obtain 2.3 g of an yellow powder. This is referred to as DPAVBi-1.

This was again dissolved in 50 ml of hot toluene, and recrystallized three times. As a result, obtained was 1.6 g of an yellow powder. This is referred to as DPAVBi-2.

PRODUCTION EXAMPLE 5

Production of Electron-Transporting Material:

As the electron-transporting material, used herein was a Dojin Chemical's commercial product, aluminium-tris(8-hydroxyquinolinol) (Alq).

This has a structure of the following chemical formula:

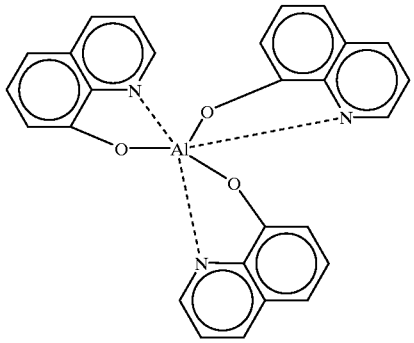

1.0 g of Dojin Chemical's Alq (this is referred to as Alq-1) was purified by subliming it two times at a boat temperature of 300° C. and in a vacuum of $10^{-5}$ Torr to obtain 0.7 g of an yellow powder. This is referred to as Alq-2.

Measurement of Electron Spin Number $\alpha$

The organic compounds produced in Production Examples 1 to 5 were subjected to ESR measurement.

First, the organic compounds were dried in a desiccator for 24 hours, and a suitable amount of each was put into an ESR sample tube of quartz (inner diameter: 4.0 mm), and subjected to ESR measurement at an atmospheric pressure.

Next, a standard sample, DPPH having an electron spin number of $6.9\times10^{15}$/mg was put into a sample tube of the same material and the same size as that used for the organic compounds, and subjected to ESR measurement under the same condition as that for the organic compounds.

The ESR apparatus used herein is one manufactured by JEOL (Model JES-FE3XG: X-band, wavelength 3 cm).

The condition for the ESR measurement is mentioned below.

As the cavity, used was a $TE_{011}$, cylindrical mode. The microwave output was 1.00 mW; the modulation pulse was 4.00 G;

and the degree of amplification was $1\times10^3$ In order to evade the influence of temperature charge on the sample being measured, city water was applied to the outer jacket of the cavity by which the cavity was kept at the temperature of water, while the inside of the cavity was kept at a constant temperature by introducing dry nitrogen gas thereinto.

The spectra of the standard sample and the organic compounds thus measured were recorded as differential data, and the data were integrated to obtain the ESR intensity of each compound. From the integrated data, obtained was the electron spin number, $\alpha$, of each organic compound, according to the numerical equations (2) and (3) noted above. The results are in Table 1 below.

TABLE 1

| Sample | Electron Spin Number (/mg) |
|---|---|
| DPVTP-1 | $2.4\times10^{13}$ |
| DPVTP-2 | $7.5\times10^{12}$ |
| DPAVBi-1 | $2.O\times10^{13}$ |
| DPAVBi-2 | $7.4\times10^{11}$ |
| MTDATA-1 | $4.9\times10^{13}$ |
| MTDATA-2 | $1.3\times10^{12}$ |
| NPD-1 | $3.7\times10^{13}$ |
| NPD-2 | $8.6\times10^{12}$ |
| Alq-1 | $3.4\times10^{13}$ |
| Alq-2 | $8.8\times10^{12}$ |

EXAMPLE 1

A film of indium-tin-oxide (In—Ti—O film—hereinafter referred to as ITO film) having a thickness of 100 nm (this corresponds to anode) was formed on a glass sheet (25 mm×75 mm×1.1 mm) through vapor deposition to prepare a transparent substrate. This transparent substrate was ultrasonically washed first with isopropyl alcohol for 5 minutes and then with water for 5 minutes, and thereafter further washed in a UV ion washer (by Samco International) at a substrate temperature of 150° C. for 20 minutes.

This was dried with dry nitrogen gas, and then fixed on a substrate holder in a commercially—available vapor deposition apparatus (by ULVAC Japan). This vapor deposition apparatus was equipped with a plurality of independent resistance-heating boats of molybdenum, into which were put vaporizing organic compounds. Precisely, 200 mg of MTDATA-1, 200 mg of NPD-1, 200 mg of DPVTP-2, 200 mg of DPAVBi-1 and 200 mg of Alq-1 were separately put into those boats.

After the vaporizing organic compounds were thus separately put on those resistance-heating boats, the vacuum chamber of the apparatus was degassed to have a vacuum degree of $4\times10^{-6}$ Torr, and the boat with MTDATA-1 being put therein was electrically heated up to 360° C. so that the compound in the boat was vaporized and deposited onto the transparent substrate at a deposition rate of from 0.1 to 0.3 nm/sec to form a layer of MTDATA-1 having a thickness of 60 nm.

Next, the boat with NPD—1 being put therein was electrically heated up to 260° C. so that the compound in the boat was vaporized and deposited over the MTDATA-1 layer at a deposition rate of from 0.1 to 0.3 nm/sec to form a layer of NPD-1 having a thickness of 20 nm.

Next, the boat with DPVTP-2 being put therein and the boat with DPAVBi-1 being put therein were electrically heated at the same time to form a light-emitting layer of DPVTP-2 and DPAVBi-1 having a thickness of 40 nm. The deposition rate of DPVTP- 2 was from 2.8 to 3.0 nm/sec, and that of DPAVBi-1 was from 0.1 to 0.13 nm/sec.

Next, the boat with Alq-1 being put therein was electrically heated so that the compound was vaporized and deposited over the light-emitting layer at a deposition rate of from 0.1 to 0.3 nm/sec to form a layer of Alq-1 having a thickness of 20 nm.

Next, the thus-layered substrate was taken out of the vacuum chamber, and a stainless steel mask was positioned on the electron injection layer, and this substrate was again fixed on the substrate holder. Next, a cathode-forming, vaporizing material of an aluminium-lithium (Al—Li) alloy having a lithium content of 5 atomic % was vaporized and deposited over the substrate at a deposition rate of from 0.5 to 1.0 nm/sec to form a cathode having a thickness of 150 nm. During the deposition, the vacuum chamber was controlled to have a vacuum degree of $1\times10^{-6}$ Torr.

A direct current of 6 V was applied to the thus-produced, organic EL device, between the ITO electrode (anode) and the Al—Li alloy electrode (cathode) of the device, whereupon the device emitted uniform blue light.

The half-life time of the organic EL device (the time within which the initial luminance, 300 cd/m$^2$, of the device was attenuated to 150 cd/m$^2$) was measured by driving the device at a constant current ina nitrogen atmosphere. The half-life time of the device thus measured is shown in Table 2.

EXAMPLE 2

An organic EL device was produced in the same manner as in Example 1, except that DPVTP-2 was replaced with DPVTP-1 and that MTDATA-1 was replaced with MTDATA-2.

A direct current of 6 V was applied to this organic EL device, between the ITO electrode (anode) and the Al—Li alloy electrode (cathode) of the device, whereupon the device emitted uniform blue light. The half-life time of the device is shown in Table 2.

EXAMPLE 3

An organic EL device was produced in the same manner as in Example 1, except that DPVTP-2 was replaced with DPVTP-1 and that NPD-1 was replaced with NPD-2.

A direct current of 6 V was applied to this organic EL device, between the ITO electrode (anode) and the Al—Li alloy electrode (cathode) of the device, whereupon the device emitted uniform blue light. The half-life time of the device is shown in Table 2.

EXAMPLE 4

An organic EL device was produced in the same manner as in Example 1, except that DPVTP-2 was replaced with DPVTP-1 and that DPAVBi-1 was replaced with DPAVBi-2.

A direct current of 6 V was applied to this organic EL device, between the ITO electrode (anode) and the Al—Li alloy electrode (cathode) of the device, whereupon the device emitted uniform blue light. The half-life time of the device is shown in Table 2.

EXAMPLE 5

An organic EL device was produced in the same manner as in Example 1, except that DPVTP-2 was replaced with DPVTP-1 and that Alq-1 was replaced with Alq-2.

A direct current of 6 V was applied to this organic EL device, between the ITO electrode (anode) and the Al—Li alloy electrode (cathode) of the device, whereupon the device emitted uniform blue light. The half-life time of the device is shown in Table 2.

EXAMPLE 6

An organic EL device was produced in the same manner as in Example 1, except that MTDATA-1 was replaced with MTDATA-2, that NPD-1 was replaced with NPD-2, that DPAVBi-1 was replaced with DPAVBi-2 and that Alq-1 was replaced with Alq-2.

A direct current of 6V was applied to this organic EL device, between the ITO electrode (anode) and the Al—Li alloy electrode (cathode) of the device, whereupon the device emitted uniform blue light. The half-life time of the device is shown in Table 2.

COMPARATIVE EXAMPLE 1

An organic EL device was produced in the same manner as in Example 1, except that DPVTP-2 was replaced with DPVTP-1.

A direct current of 6 V was applied to this organic EL device, between the ITO electrode (anode) and the Al—Li alloy electrode (cathode) of the device, whereupon the device emitted uniform blue light. The half-life time of the device is shown in Table 2.

TABLE 2

| No. | Hole-injecting Material | Hole-transporting Material | Light-emitting Material | Dopant | Electron-transporting Material | Half-life time (hrs) |
|---|---|---|---|---|---|---|
| Example 1 | MTDATA-1 | NPD-1 | DPVTP-2 | DPAVBi-1 | Alq-1 | 5,200 |
| Example 2 | MTDATA-2 | NPD-1 | DPVTP-1 | DPAVBi-1 | Alq-1 | 4,700 |
| Example 3 | MTDATA-1 | NPD-2 | DPVTP-1 | DPAVBi-1 | Alq-1 | 4,900 |
| Example 4 | MTDATA-1 | NPD-1 | DPVTP-1 | DPAVBi-2 | Alq-1 | 4,200 |
| Example 5 | MTDATA-1 | NPD-1 | DPVTP-1 | DPAVBi-1 | Alq-2 | 4,600 |
| Example 6 | MTDATA-2 | NPD-2 | DPVTP-2 | DPAVBi-2 | Alq-2 | 6,000 |
| Comp. Example 1 | MTDATA-1 | NPD-1 | DPVTP-1 | DPAVBi-1 | Alq-1 | 1,800 |

From the data of Examples 1 to 6 in Table 2, it is known that the half-life time of the organic EL devices comprising any one of the organic compounds having an electron spin number, $\alpha$, of not more than $10^{13}$ is longer by more than 2 times than that of the organic EL device of Comparative Example 1 not comprising it.

In addition, it is further known that the half-life time of the organic EL device, of which all layers are of the organic compounds having an electron spin number, $\alpha$, of not more than $10^{13}$, is much longer than that of any others.

As has been described in detail hereinabove, the organic EL device of the invention is produced through vapor deposition, for which are used organic compounds having an electron spin number of not more than a defined limit, and its luminous efficiency is kept good during long-term driving, and the half-life time of the device is much prolonged. In addition, the durability of the device is good. Accordingly, the organic EL device of the invention is favorably used, for example, in displays in information appliances.

While the invention has been described in detail and with reference to specific embodiments thereof, it will be apparent to one skilled in the art that various changes and modifications can be made therein without departing from the spirit and scope thereof.

What is claimed is:

1. An organic electroluminescent device, comprising one or more organic compound layers that include at least one organic light-emitting layer and are sandwiched between a pair of electrodes of anode and cathode, wherein at least one organic compound used for forming said organic compound layers has a number of electron spins existing therein not more than $10^{13}$ per mg of the compound, and wherein said at least one organic compound is selected from the group consisting of 4,4"-bis(2,2-diphenylvinyl-1-yl)-p-tert-phenylene; 4,4',4"-tris-[N-m-tolyl)-N-phenylamino]-triphenylamine; N,N'-di-(naphthyl-1yl)-N,N'-diphenyl-4,4"-benzidine; 4,4'-bis-[2-[4-(N,N-diphenylamino)phenyl-1-yl]-vinyl-1-yl]-1,1'-biphenyl; and aluminum-tris-(8-hydroxyquinolinol).

2. The organic electroluminescent device as claimed in claim 1, wherein the organic compound layers are formed through vapor deposition.

3. The organic electroluminescent device as claimed in claim 1 or 2, wherein the number of electron spins existing in the organic compound used for forming the organic light-emitting layer is not more than $10^{13}$ per mg of the compound.

4. The organic electroluminescent device as claimed in claim 1 or 2, wherein the number of electron spins existing in the organic compound used for forming the organic compound layer for hole injection or transportation is not more than $10^{13}$ per mg of the compound.

5. The organic electroluminescent device as claimed in claim 1 or 2, wherein the number of electron spins existing in the organic compound used for forming the organic compound layer for electron injection or transportation is not more than $10^{13}$ per mg of the compound.

6. The organic electroluminescent device as claimed in claim 1 or 2, wherein said at least one organic compound is 4,4"-bis(2,2-diphenylvinyl-1-yl)-p-tert-phenylene.

7. The organic electroluminescent device as claimed in claim 1 or 2, wherein said at least one organic compound is 4,4',4"-tris-[N-m-tolyl)-N-phenylamino]-triphenylamine.

8. The organic electroluminescent device as claimed in claim 1 or 2, wherein said at least one organic com pound is N,N'-di-(naphthyl-1-yl)-N,N'-diphenyl-4,4"-benzidine.

9. The organic electroluminescent device as claimed in claim 1 or 2, wherein said at least one organic compound is 4,4'-bis-[2-[4-(N,N-diphenylamino)phenyl-1-yl]-vinyl-1-yl]-1,1'-biphenyl.

10. The organic electroluminescent device as claimed in claim 1 or 2, wherein said at least one organic compound is aluminum-tris-(8-hydroxyquinolinol).

* * * * *